US006053342A

United States Patent [19]

Chomik

[11] Patent Number: 6,053,342

[45] Date of Patent: Apr. 25, 2000

[54] INFANT FEEDING BOTTLE WITH PRESSURE EQUALIZING DIAPHRAGM

[75] Inventor: Richard Chomik, Garwood, N.J.

[73] Assignee: Playtex Products, Inc., Westport, Conn.

[21] Appl. No.: 08/923,372

[22] Filed: Sep. 3, 1997

[51] Int. Cl.[7] ..... A61J 9/00; A61J 9/04

[52] U.S. Cl. ..... 215/11.5; 215/11.1; 220/DIG. 27

[58] Field of Search ..... 215/11.1, 11.4, 215/11.5; 220/DIG. 27

[56] References Cited

U.S. PATENT DOCUMENTS

| | | | |
|---|---|---|---|
| 357,439 | 2/1887 | Wheelock . | |
| 577,199 | 2/1897 | Neidlinger . | |
| 921,387 | 5/1909 | Ette | 215/11.5 |
| 2,060,212 | 11/1936 | Herstein | 215/11.1 |
| 2,084,099 | 6/1937 | Maccoy | 215/11.5 X |
| 2,365,947 | 12/1944 | Ganson | 215/11.5 |
| 2,774,500 | 12/1956 | Budiani | 215/11.1 X |
| 2,982,432 | 5/1961 | Mehl | 215/11.1 |
| 3,134,495 | 5/1964 | Carbonel | 215/11.5 |
| 3,768,682 | 10/1973 | Meyers et al. | 215/11.5 |
| 4,010,861 | 3/1977 | Welten | 215/11.5 |
| 4,401,224 | 8/1983 | Alonso | 215/11.5 |
| 4,545,491 | 10/1985 | Bisgaard | 215/11.5 |
| 4,685,577 | 8/1987 | Chen | 215/11.5 |
| 4,723,668 | 2/1988 | Cheng | 215/11.5 |
| 4,865,207 | 9/1989 | Joyner et al. | 215/11.5 |
| 4,928,836 | 5/1990 | Wu et al. | 215/11.5 |
| 5,071,017 | 12/1991 | Stull | 215/260 |
| 5,215,312 | 6/1993 | Knappe et al. | 277/1 |
| 5,339,971 | 8/1994 | Rohrig | 215/11.5 |
| 5,431,290 | 7/1995 | Vinciguerra | 215/11.5 |
| 5,433,353 | 7/1995 | Flinn | 222/481 |
| 5,499,729 | 3/1996 | Greenwood et al. | 215/11.5 |
| 5,544,766 | 8/1996 | Dunn et al. | 215/11.1 |
| 5,601,199 | 2/1997 | Marty | 215/11.4 X |
| 5,607,074 | 3/1997 | De Gennaro | 215/11.5 |

FOREIGN PATENT DOCUMENTS

| | | | |
|---|---|---|---|
| 1058610 | 3/1954 | France | 215/11.5 |
| 2190596 | 11/1987 | United Kingdom | 215/11.5 |
| 2238729 | 6/1991 | United Kingdom | 215/11.5 |
| 9007320 | 7/1990 | WIPO | 215/11.5 |

*Primary Examiner*—Sue A. Weaver

*Attorney, Agent, or Firm*—Ohlandt, Greeley, Ruggiero & Perle,LLP

[57] ABSTRACT

A bottle assembly includes a bottle having a first open end and a second open end, a nipple assembly affixed to the first open end, a vented cap affixed to the second open end, and an elastomeric diaphragm affixed to the second open end by the vented cap. The vented cap has at least one slot. The elastomeric diaphragm has a plurality of resealable perforations and at least one integral tab extending therefrom. The integral tab is adapted to be inserted into and seal the slot.

29 Claims, 5 Drawing Sheets

INFANT FEEDING BOTTLE WITH PRESSURE EQUALIZING DIAPHRAGM

FIELD OF THE INVENTION

The present invention relates generally to an improved infant feeding bottle assembly. More particularly, the present invention relates to an infant feeding bottle assembly having an improved pressure equalizing diaphragm that alleviates the vacuum created in the bottle during feeding, while preventing leakage around the pressure equalizing diaphragm.

BACKGROUND OF THE INVENTION

Baby bottles having flexible nipples are commonly used to feed infants and children milk, formula, juices and other fluids. During use, however, as the baby sucks on the nipple and withdraws the fluid, a partial vacuum is formed within the bottle. This vacuum can make feeding more difficult, by requiring the baby to suck with much greater force, which can discourage the baby and cause it to stop feeding sooner than desired. Moreover, the vacuum can cause the nipple to collapse.

To address this problem, a variety of vented bottle assemblies have been developed. One such method involves the use of a perforated elastomeric diaphragm attached to the bottom of the bottle. This diaphragm allows air in to alleviate the vacuum when the bottle is inverted and fluid is withdrawn. When the bottle is upright, however, and fluid is resting on the diaphragm, the perforations are effectively sealed and fluid does not pass through the perforations.

This bottle assembly, and a related process for equalizing pressure in a bottle, are disclosed and claimed in U.S. Pat. No. 5,499,729 to Greenwood et al., which issued on Mar. 19, 1996. The teachings of that patent are herein incorporated by reference. The bottle assembly claimed in the Greenwood et al. patent provides excellent vacuum control and fluid flow, in combination with ease of cleaning. However, the structure as disclosed in the Greenwood et al. patent suffers from one drawback. The diaphragm is merely pressed into engagement with the cap, and is only loosely retained therein by the threads of the cap before the cap is screwed onto the bottle. It is not affixed to the cap. While fluid does not leak through the multiple perforations in the central portion of the diaphragm, many users have experienced leakage due to improper placement of the diaphragm in its securing cap. If the elastomeric rim of the diaphragm is not replaced properly in the cap after cleaning, a seal will not form between the bottom lip of the bottle, the diaphragm's rim, and the cap. Fluid will then leak around the diaphragm and out of the air holes in the cap. Moreover, the typical user may not understand what is causing the leakage, and may wrongly attribute it to the perforations in the diaphragm. In addition, the loose diaphragm, separate from the remainder of the assembly, may be found and swallowed by a small child.

Accordingly, an improved bottle assembly is required that ensures that the diaphragm is properly and sealingly seated in the cap, to prevent leakage of fluid from the assembly. Moreover, such an improved assembly permits a user to disassemble and reassemble conveniently and without the concern that leakage will occur due to misalignment.

SUMMARY OF THE INVENTION

Thus, it is an object of the present invention to provide an improved bottle assembly that is leak-proof when upright.

It is a further object of the present invention to provide an improved diaphragm and cap assembly that ensures a secure seal, and that minimizes the possibility of improper assembly by the user.

It is yet a further object of the present invention to provide an improved diaphragm and cap assembly that can remain assembled indefinitely to ensure a proper seal and to minimize the chance that the flexible diaphragm could be found and swallowed by a child.

It is a further object of the present invention to provide an improved diaphragm, cap and bottle holder assembly that is easy to clean and easy to assemble.

Accordingly, the present invention provides a bottle assembly including a bottle having a first open end and a second open end, a nipple assembly affixed to the first open end, a vented cap affixed to the second open end, the vented cap having at least one slot; and an elastomeric diaphragm affixed to the second open end by the vented cap. The elastomeric diaphragm has a plurality of resealable perforations and at least one integral tab extending therefrom. The integral tab is adapted to be inserted into and seal the slot.

DESCRIPTION OF THE PREFERRED EMBODIMENTS

Figure 1:
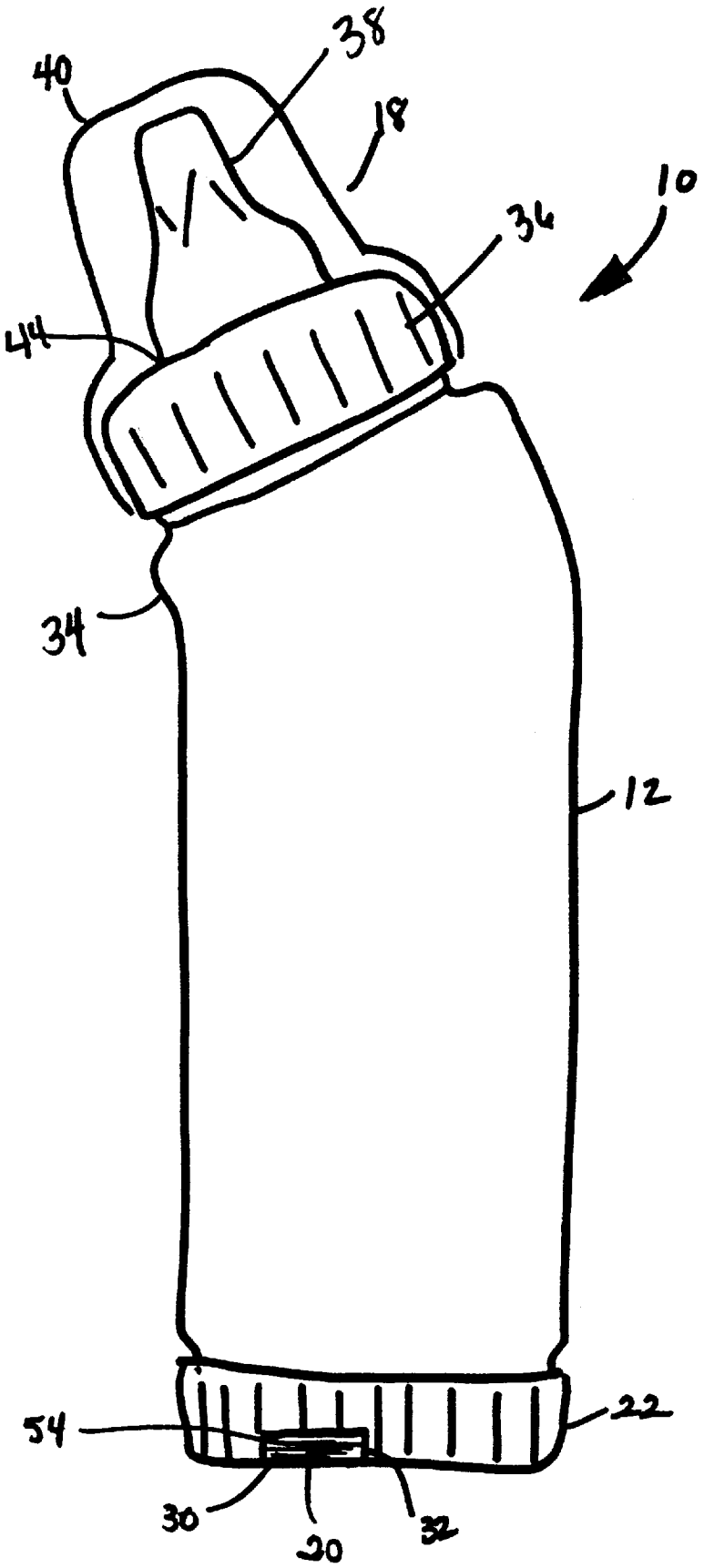
FIG. 1 is a side view of a preferred bottle assembly of the present invention.
Figure 2A:
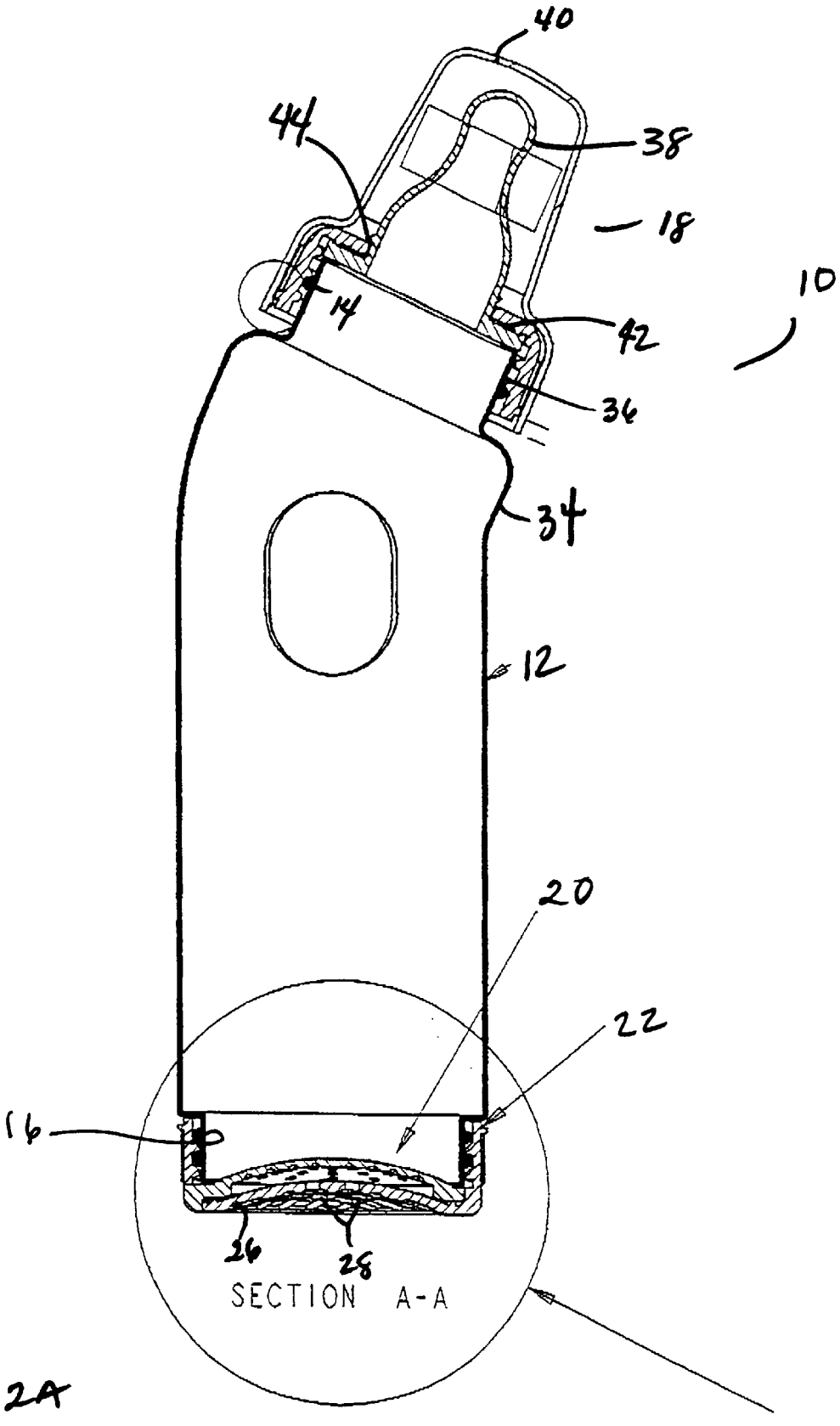
FIG. 2A is a cross-sectional view of the bottle assembly of FIG. 1.
Figure 2B:
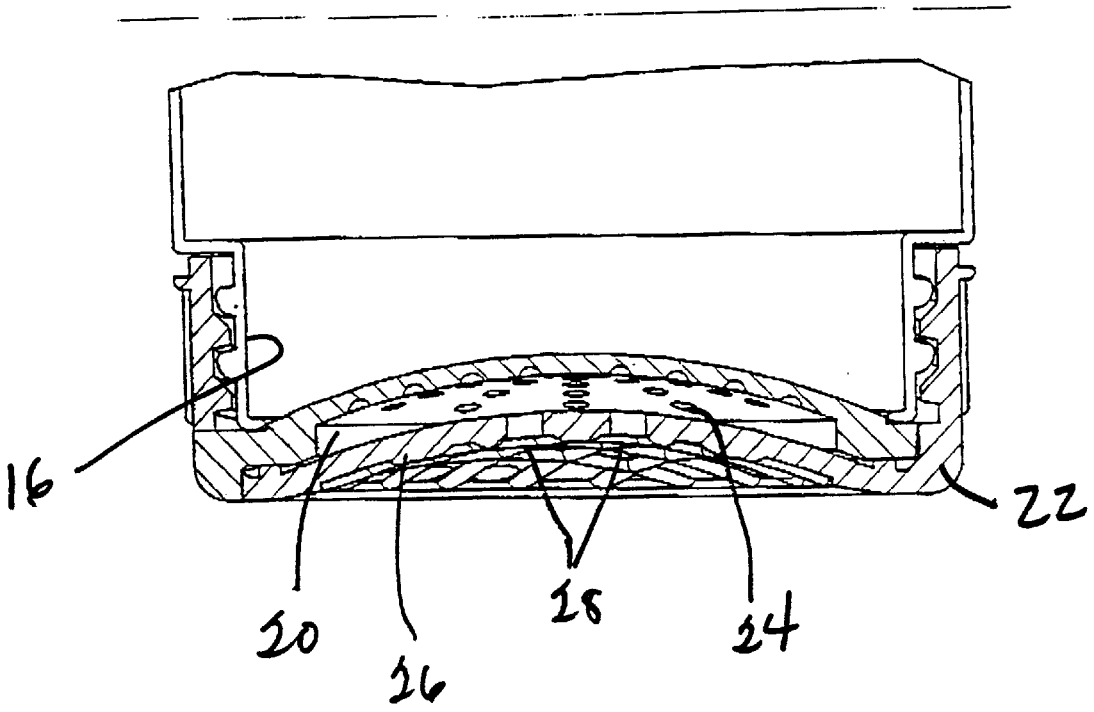
FIG. 2B is an enlarged view of the Section A—A of FIG. 2A.

Referring to the figures and, in particular, FIGS. 1, 2A and 2B, the improved bottle assembly of the present invention is generally referred to by reference numeral 10. The bottle assembly 10 includes a cylindrical bottle 12 having a first open end 14 and a second open end 16. In the preferred embodiment shown in FIG. 1, the first open end 14 and the second open end 16 are threaded. The bottle assembly 10 may also include a nipple assembly 18 adapted to be secured to the first end 14 and an elastomeric diaphragm 20 adapted to be secured to the second end 16. The elastomeric diaphragm 20 is preferably mounted to the second end 16 by a mating threaded cap 22. The elastomeric diaphragm 20 has resealable perforations 24 therethrough (see FIGS. 3 and 4) in multiple locations, to permit air to flow in when a partial vacuum is formed in the bottle 12 during feeding. The threaded cap 22 has a domed base 26 with air vents 28.

Figure 3:
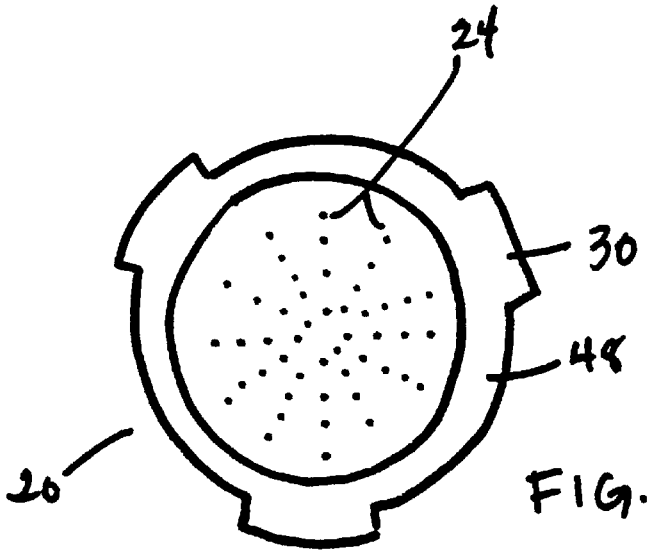
FIG. 3 is a top view of a preferred diaphragm of the present invention.
Figure 4:
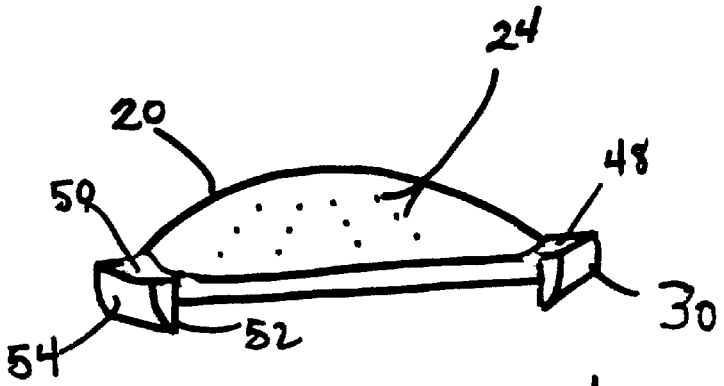
FIG. 4 is a side view of the diaphragm of FIG. 3.

According to the improvements of the present invention, the elastomeric diaphragm 20 has at least one integral tab 30 (best seen in FIGS. 3 and 4). In the preferred embodiment shown in FIGS. 3 and 4, the elastomeric diaphragm 20 has three integral tabs 30. In conjunction, the cap 22 has a corresponding number of mating slots 32 (see FIG. 5) about its circumference. The integral tabs 30 of the elastomeric diaphragm 20 are designed to lock into the slots 32 of the cap 22. This improvement ensures that the elastomeric diaphragm 20 is properly and securely seated in cap 22, so that a leak-proof seal will be formed when the cap bearing the diaphragm 20 is attached to the bottle 12.

As shown in FIGS. 1 and 2, the bottle assembly 10 of this preferred embodiment includes cylindrical bottle 12. The bottle 12 is preferably transparent, to allow the contents and interior of the bottle 12 to be seen during feeding and cleaning. Thus, bottle 12 is preferably reusable. The neck 34 of the bottle 12 is preferably angled to facilitate feeding. Both first and second ends 14,16 of the bottle 12 are open and, as stated above, each is preferably threaded. The nipple assembly 18 is mounted to the first end 14 of the bottle 12, and preferably includes a threaded retaining ring 36 that is adapted to be removably secured to threaded first end 14, a nipple 38 and a protective lid 40. The nipple 38 preferably includes an annular mounting flange 42. In a preferred embodiment, the threaded retaining ring 36 has a central aperture 44 through which the nipple 38 projects, while mounting flange 42 is held against the retaining ring 36. The flange 42 of the nipple 38 then seals against the first end 14 of the bottle 12 when the retaining ring 36 is screwed onto the bottle.

It is important, for proper functioning of elastomeric diaphragm 20, that the nipple 38 does not have a vent in its flange 42 or elsewhere, apart from its drinking aperture. Elastomeric diaphragm 20, not a separate vent on the nipple 38, acts as the bottle's vent. Eliminating a vent in the nipple 38 can help to make the nipple essentially dripless, although the preferred Y-cut opening in the nipple (instead of the traditional through hole) is primarily responsible for ensuring that the nipple is dripless. A protective lid 40 can then be removably attached to the retaining ring 36 to keep the nipple 38 sanitary and to catch any leakage of fluid through the nipple.

As shown in FIGS. 3 and 4, the improved elastomeric diaphragm 20 of the present invention is slightly domed in contour, and has a plurality of perforations 24. The perforations 24 are preferably formed through the centers of a plurality of dish-shaped depressions (not shown) formed in the diaphragm 20. The perforations 24 can be pinpoint (i.e., circular) perforations or small slit perforations, or can be any other resealable configuration. The perforations 24 are arranged in a starburst pattern, as shown in FIG. 3. However, other geometric or random patterns are also suitable. It is the number, concentration and type of perforations, not their pattern, that is most relevant to their performance. Most preferably, about 48 holes are arranged close together in a compact area of the diaphragm 20. The circumference 48 of the diaphragm 20 is flattened top and bottom to form a seating and sealing surface. Extending from and below the circumference 48 are three integrally formed tabs 30. As shown in FIG. 4, each tab 30 has a flat top surface 50, a straight first side 52 and a curved second side 54, thus forming a gripping projection.

Figure 5:
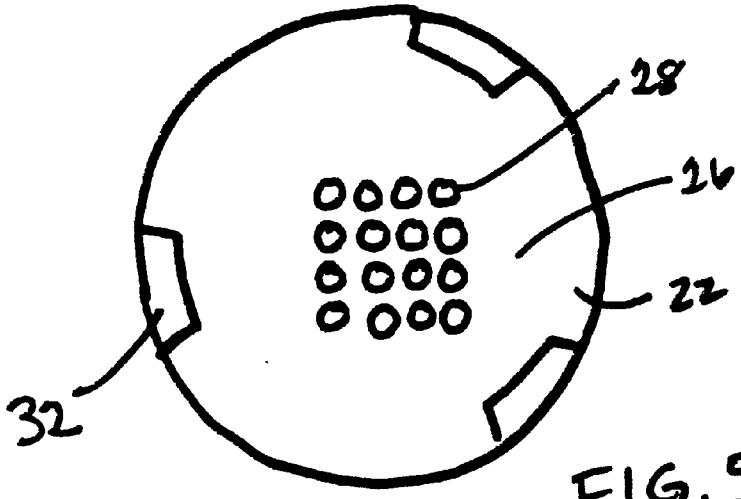
FIG. 5 is a top view of a preferred cap of the present invention.
Figure 6:
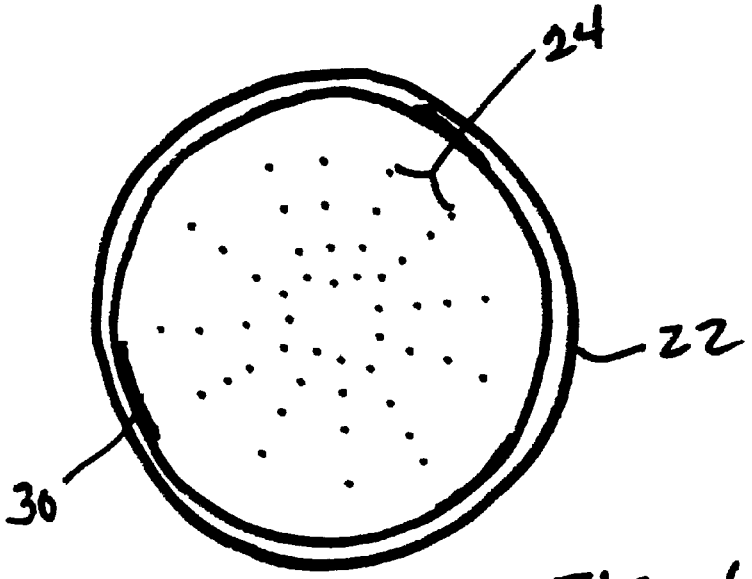
FIG. 6 is a top view of the assembled diaphragm of FIG. 3 and cap of FIG. 5.

As shown in FIG. 5, the threaded cap 22 has three slots 32 that are generally rectangular in shape and are formed to accept and lock in the corresponding number of tabs 30 of the diaphragm 20. The cap 22 has a somewhat domed inverted base 26 bearing air vents 28. The domed shape of inverted base 26 preferably is similar to that of the elastomeric diaphragm 20.

The cap 22 preferably is supplied pre-assembled, with the elastomeric diaphragm 20 seated in the cap and with the tabs 30 locked into the slots 32 of the cap. While the diaphragm 20 is removable by the consumer, it can also be left in place through multiple uses and washings. The size of the air vents 28 permits the underside of the diaphragm 20 to be cleaned and sanitized sufficiently without removal. Moreover, if the diaphragm 20 is removed between uses, the tabs 30 ensure that the diaphragm 20 is replaced properly before the next use. Until the tabs 30 are properly engaged, the diaphragm 20 will not seat properly in the cap 22, but will bulge upwardly. Moreover, the tabs 30 can be viewed from the outside of the cap 22 when inserted through the slots 32. Because the second side 54 of the tabs 30 is situated on the outside, and is curved to match the outer contour of the cap 22, it is readily seen when the tabs are only partially inserted through the slots 32. When the tabs 30 are fully inserted through the slots 32, the outside of the cap 22 has a smooth, uninterrupted contour in the area of the slots and tabs. The tabs 30 must be of sufficient size to seal the slots 32 against leakage of fluid, but must not be so large as to be overly difficult to insert into the slots. Most preferably, the slots 32 and tabs 30 are of roughly equivalent length and curvature. In addition, the use of a flexible, compressible elastomeric material, such as a moldable elastomer (such as silicone), is preferred for the diaphragm 20, because it allows easy insertion of the tabs 30 into slots 32, without sacrificing an effective seal.

The tabs 30 also perform an important safety function. The elastomeric diaphragm 20, when engaged by tabs 30 into cap 22, can minimize the safety hazard of a small child finding the diaphragm 20 disassembled from the bottle assembly 10. The diaphragm 20, if loose in cap 22 or if separated from the cap, could potentially be chewed or ingested by a small child. Thus, the tabs 30, by allowing the elastomeric diaphragm 20 to be locked into the cap 22, serve to minimize the chance that a child will be harmed by ingesting or chewing the diaphragm.

It is obvious that the tabs 30 and slots 32 of the present invention can take on a variety of interlocking configurations. While three sets of tabs 30 and slots 32 are preferred, any number of sets can be used. In addition, a slot or other aperture on the diaphragm could be sealingly engaged by a tab or other protrusion on the interior surface of the cap. Any structures sufficient to affix the diaphragm to the cap, while preventing fluid leakage, are within the scope of the present invention. These structures may be integral to the cap, the diaphragm, or both, or can be independent clips, retaining rings or other such devices. In addition, structures other than the cap disclosed herein can be used to mount the diaphragm to the bottle.

Various modifications may be made as will be apparent to those skilled in the art. Thus, it will be obvious to one of ordinary skill in the art that the foregoing description and drawings are merely illustrative of certain preferred embodiments of the present invention, and that various obvious modifications can be made to these embodiments in accordance with the spirit and scope of the appended claims.

What is claimed is:

1. A bottle assembly comprising:

a bottle having a first open top end and a second open bottom end;

a nipple assembly adapted to be mounted to said first open top end, said nipple assembly including a nipple;

a vented bottom cap apart from said nipple assembly and adapted to be mountable to said second open bottom end, said vented bottom cap having a base with at least one slot therethrough; and an elastomeric diaphragm mounted to said second bottom open end by said vented bottom cap, wherein said elastomeric diaphragm has a plurality of resealable perforations therethrough and at least one tab extending from said elastomeric diaphragm, wherein said at least one tab is adapted to be inserted into said at least one slot.

2. The bottle assembly of claim 1, wherein said elastomeric diaphragm has three tabs extending therefrom, and wherein said base of said vented bottom cap has three slots therethrough and that are adapted to accept said three tabs.

3. The bottle assembly of claim 1, wherein said at least one forms a gripping projection.

4. The bottle assembly of claim 1, wherein said at least one tab and said at least one slot are of equivalent size and curvature.

5. The bottle assembly of claim 1, wherein said at least one tab has an outer contour that is flush with and conforms to the outer contour of said cap adjacent said at least one slot.

6. The bottle assembly of claim 1, wherein said perforations open to permit air inflow in response to a partial vacuum formed within said bottle during feeding.

7. The bottle assembly of claim 1, wherein said vented bottom cap includes an inverted domed base, and wherein said diaphragm is domed.

8. The bottle assembly of claim 7, wherein said inverted domed base has a contour and said diaphragm has a contour, and wherein the contours of said inverted domed base and said diaphragm are equivalent.

9. The bottle assembly of claim 1, wherein said vented bottom cap includes at least one venting aperture, and said at least one venting aperture is of sufficient size to permit cleaning of said elastomeric diaphragm when said elastomeric diaphragm is affixed to said vented bottom cap.

10. The bottle assembly of claim 1, wherein said at least one tab prevents said elastomeric diaphragm from seating properly in said vented bottom cap until said at least one tab is fully inserted into said at least one slot.

11. The bottle assembly of claim 1, wherein said at least one tab is visible from outside said bottle assembly when said at least one tab is inserted into said at least one slot.

12. The bottle assembly of claim 1, wherein said elastomeric diaphragm is made of a moldable elastomer.

13. A bottle assembly comprising:

a bottle having a first open top end and a second open bottom end;

a nipple assembly removably affixed to said first open top end, said nipple assembly including a nipple;

a vented bottom cap apart from said nipple assembly and removably affixed to said second open bottom end; and an elastomeric diaphragm removably affixed to said second open bottom end by said vented cap, wherein said elastomeric diaphragm has a plurality of resealable perforations therethrough, wherein said vented bottom cap includes a base with at least one slot therethrough, wherein said elastomeric diaphragm includes at least one tab extending from said elastomeric diaphragm, and wherein said at least one tab is adapted to be inserted into and seal said at least one slot.

14. A bottle assembly, comprising:

a bottle having a first open top end and a second open bottom end;

a nipple assembly adapted to be mounted to said first open top end, said nipple assembly including a nipple;

a vented bottom cap apart from said nipple assembly and adapted to be mountable to said second open bottom end, said vented bottom cap having a base that is joined at a junction with a peripheral upstanding side wall, said side wall, junction and base having at least one slot therethrough that runs continuously from a lower portion of said side wall through said junction and into a portion of said base; and an elastomeric diaphragm mounted to said second bottom open end by said vented cap, wherein said elastomeric diaphragm has a plurality of resealable perforations therethrough and at least one integral peripheral tab extending radially outwardly and downwardly from said elastomeric diaphragm, wherein said at least one integral tab is inserted and locked into said at least one slot.

15. The bottle assembly of claim 14, wherein said side wall, junction and base of said bottom cap have surfaces that define and fully enclose said slot.

16. The bottle assembly of claim 15, wherein a seal is formed between said at least one tab and said at least one slot, said seal being formed by the engagement of said at least one tab with said surfaces that define and enclose said at least one slot.

17. The bottle assembly of claim 14, wherein said slot is formed by a radially outwardly facing surface of said base, a downwardly facing surface of said side wall and two opposed axially extending surfaces of said side wall.

18. The bottle assembly of claim 14, wherein said at least one tab has an outer surface contour that matches the outer surface contour of said vented bottom cap such that said outer surface contour of said inserted at least one tab is flush with said outer surface contour of said vented bottom cap.

19. The bottle assembly of claim 14, wherein said bottle assembly includes a plurality of said tabs and slots.

20. An apparatus for dispensing fluid, comprising:

a reservoir having a top aperture, a bottom aperture, and, fluid dispensing means operative at said top aperture;

a perforated elastomeric diaphragm apart from said fluid dispensing means and operative at said bottom aperture;

means for mounting said perforated elastomeric diaphragm across said bottom aperture; and means for removably affixing said perforated elastomeric diaphragm to said mounting means, wherein said affixing means includes at least one tab extending from said elastomeric diaphragm, and at least one enclosed slot in said mounting means, said enclosed slot being defined and fully enclosed by surfaces of said mounting means that are in communication with each other, wherein said perforated elastomeric diaphragm is removably affixed to said mounting means by said at least one tab being inserted in and engaged with said surfaces defining said enclosed slot.

21. The apparatus of claim 20, wherein said at least one tab and said at least one slot are of equivalent size and curvature.

22. The apparatus of claim 20, wherein said top aperture is located substantially opposite said bottom aperture.

23. The apparatus of claim 20, wherein said at least one tab prevents said elastomeric diaphragm from seating properly in said mounting means until said at least one tab is fully inserted into said at least one slot.

24. An apparatus for dispensing fluid, comprising:

a reservoir having a top aperture, a bottom aperture, and, fluid dispensing means operative at said top aperture;

a perforated elastomeric diaphragm apart from said fluid dispensing means and operative at said bottom aperture, means for mounting said perforated elastomeric diaphragm across said bottom aperture; and means for removably affixing said perforated elastomeric diaphragm to said mounting means, wherein said affixing means includes at least one tab extending upwardly from said mounting means, and at least one enclosed slot in said elastomeric diaphragm, said tab having a gripping projection, and said slot being defined and fully enclosed by surfaces of said elastomeric diaphragm that are in communication with each other, wherein said perforated elastomeric diaphragm is removably affixed to said mounting means by said at least one tab being inserted in said enclosed slot and said gripping projection being engaged with at least one of said surfaces defining said enclosed slot.

25. The apparatus of claim 24, wherein said at least one tab and said at least one slot are of equivalent size and curvature.

26. The apparatus of claim 24, wherein said at least one tab prevents said perforated elastomeric diaphragm from seating properly in said mounting means until said at least one tab is fully inserted into said at least one slot.

27. A vented cap assembly mountable on a first end of a bottle, comprising:

means for mounting said vented cap assembly to the first end of the bottle;

a perforated elastomeric diaphragm; and means for removably affixing said perforated elastomeric diaphragm to said mounting means, wherein said affixing means includes at least one tab extending from said elastomeric diaphragm, and at least one enclosed slot in said mounting means, said slot being defined and fully enclosed by surfaces of said mounting means that are in communication with each other, wherein said perforated elastomeric diaphragm is removably affixed to said mounting means by said at least one tab being inserted in and engaged with said surfaces defining said enclosed slot.

28. The assembly of claim 27, wherein the bottle has a second end, and wherein the second end is adapted to receive nipple means.

29. The assembly of claim 27, wherein said mounting means is a cap having at least one air vent.

* * * * *